US006055707A

United States Patent [19]

Simioni

[11] Patent Number: 6,055,707

[45] **Date of Patent: *May 2, 2000**

[54] FASTENER FOR A SPORTS SHOE

[75] Inventor: Matteo Simioni, Volpago Del Montello, Italy

[73] Assignee: Lange International S.A., Fribourg, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/972,195

[22] Filed: Nov. 18, 1997

[30] Foreign Application Priority Data

Nov. 22, 1996 [IT] Italy ..... MI960765 U

[51] Int. Cl.[7] ..... A43C 11/00

[52] U.S. Cl. ..... 24/68 SK

[58] Field of Search ..... 24/68 R, 68 SK, 24/69 R, 70 R, 71 R, 69 SK, 70 SK, 71 SK; 36/50.5

[56] References Cited

U.S. PATENT DOCUMENTS

| | | | |
|---|---|---|---|
| 4,395,801 | 8/1983 | Gabrielli | 24/70 SK |
| 4,796,337 | 1/1989 | Marxer | 24/70 SK |

FOREIGN PATENT DOCUMENTS

| | | |
|---|---|---|
| 0161441 | 11/1985 | European Pat. Off. . |
| 0242531 | 10/1987 | European Pat. Off. . |
| 2441355 | 6/1980 | France . |
| 2563978 | 11/1985 | France . |

*Primary Examiner*—James R. Brittain
*Attorney, Agent, or Firm*—Bugnion S.A.; John Moetteli

[57] ABSTRACT

Fastener for a sports shoe comprising, on the one hand, a strip (1) carrying a clasp (3) the position of which can be adjusted along the strip and, on the other hand, a tensioner (4) fitted with a strap (8) which catches on the clasp. The strip has sawtooth teeth (2) and the clasp (3) has a pawl for holding it in place between the teeth.

2 Claims, 1 Drawing Sheet

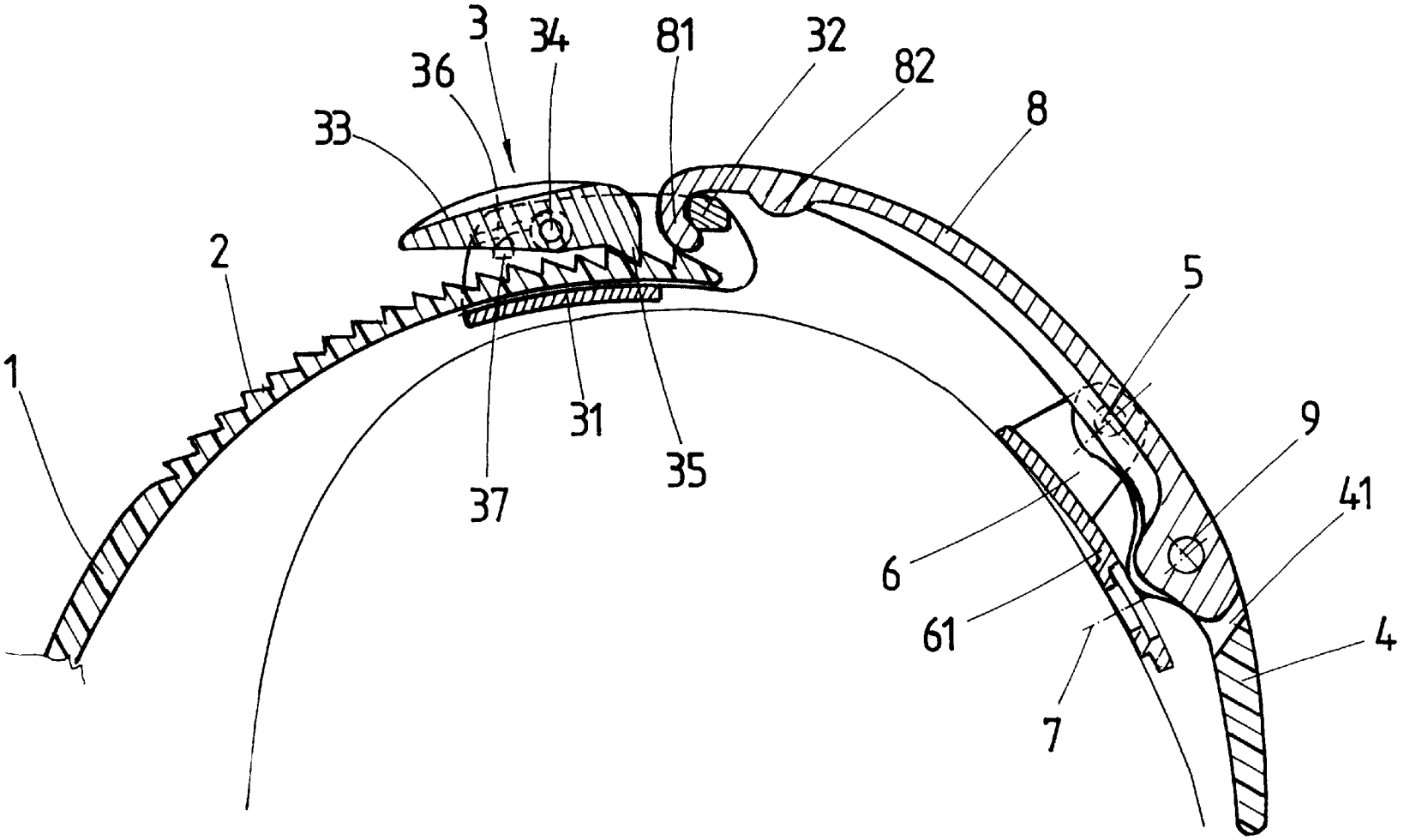
4
41
9
5
7
8
61
6
82
32
81
35
31
34
3
37
36
33
2
1

FASTENER FOR A SPORTS SHOE

FIELD OF THE INVENTION

The invention relates to a fastener for a sports shoe comprising, on the one hand, a strip intended to be fixed to a first part of the shoe and on which there is mounted a clasp the position of which can be adjusted by sliding it along the strip and which can be locked in the desired position on the strip and, on the other hand, a tensioner intended to be fixed to a second part of the shoe which is to be fastened to the first part of the shoe and fitted with a strap the end of which has a shape that complements said clasp so that it can be caught on said clasp.

PRIOR ART

A device of this type is known from Italian Utility Model No. 1 132 728. This device comprises a strip which is notched on its underside and the clasp consists of a rack articulated to a clevis mount which has teeth that engage in the notches of the notched strip. The rack acts simultaneously as a clasp and as a cam for trapping the strip between the clevis mount and the rack. The advantages of this device are that it has a wide range of adjustments, a simple tensioning device, and the fact that it is possible to have a clasp which is always situated on the top of the shoe. However, the position of the rack is rather awkward to adjust because it is difficult to lift the rack, particularly when wearing gloves, in order to release the notched strip. Furthermore, this release needs to be achieved in both directions of movement of the notched strip, in particular in the direction that corresponds to increasing the tightness, an operation that commonly takes place after having put one's shoes on and initially tightened them.

SUMMARY OF THE INVENTION

The object of the invention is to make it easier for the clasp to be adjusted along its strip.

To achieve this, the fastener according to the invention is one wherein the strip has sawtooth teeth on its upper face and the clasp has a pawl that fits between said teeth for the one-way locking, in tension, of the clasp to the strip.

The amount of tightness can be increased simply by pushing on the clasp. To relax the tightness, simply pressing on the pawl allows the toothed strip to be released. These operations can be performed without taking one's gloves off.

BRIEF DESCRIPTION OF THE DRAWING

The attached drawing depicts one embodiment of the fastener according to the invention.

The single FIGURE of the drawing depicts the fastener of the invention in axial section.

DESCRIPTION OF THE PREFERRED EMBODIMENT

Referring now fastener comprises a strip 1 of which the end which has not been depicted is fixed by means of a rivet to a first part of a shoe. Over a substantial part of its length, this strip has sawtooth teeth 2 oriented in the direction of the point of attachment of 35 the strip. Mounted on this strip is a clasp 3 that consists of a clevis mount 31, of a crossbar 32 and of a pawl 33 articulated about a pin 34 between the cheeks of the clevis mount 31 and the nose 35 of which is kept engaged between the teeth 2 by a horn-shaped spring 36 mounted around the pin 34 and the end of which rests on a peg 37 of the clevis mount.

The fastener also comprises a tensioner lever 4 articulated, about a pin 5, to a clevis mount 6 secured to a mounting plate 61 fixed to a second part of the shoe by a rivet 7.

The tensioning lever 4 has an axial U-shaped cutout 41 in which a strap 8 is articulated about a pin 9 on the tensioning lever. The strap 8 has a hook-shaped end 81 intended to catch over the crossbar 32 of the clasp 3.

It can be seen that in order to tighten the fastener, all that is required is for the toothed strip 1 to be inserted further into the clasp by pushing the clasp along the strip. The pawl 33 hops over the teeth 2. To slacken, pressure on the pawl 33 allows the strip to be released from the clasp and allows the latter to be moved along the strip.

The strap 8 also advantageously, on its side facing the shoe, has a boss 82 situated a little way back from the hook 81, more specifically situated just far enough from the hook 81 to allow the crossbar 32 to pass to catch on the strap. Therefore when the tensioning lever 4 is opened, the boss 82 comes up against the crossbar 32 before the end 81 of the strap 8 comes up against the pawl 33. The boss 82 has the effect of making the operation of adjusting the clasp 3 easier in the case, which is the most usual one, of tightening the device: instead of grasping the clasp and pushing it along the toothed strip 1, in order to carry out an adjustment, the tensioning lever 4 is lifted slowly, exerting a small amount of pressure on the strap 8 with one's hand. The boss 82 then comes up against the crossbar 32 and pushes the clasp 3 back along the toothed strip 1. The pawl 33 hops along the teeth 2 one tooth at a time, which gives precise adjustment.

If, on the other hand, the tensioning lever 4 is raised decisively, as is normally the case when opening the buckle, the boss 82 acts like a cam when it encounters the crossbar 32, and this has the effect of lifting the strap 8 relative to the crossbar 32 so that the strap 8 disengages from the crossbar 32.

When the clasp is in the position depicted in the drawing, that is to say close to or at the end of the toothed strip 1, the strap can catch more easily on the clasp 3. Once the tensioning lever 4 has initially been fastened, which corresponds to pre-tightening, the operation described hereinabove can be used to make final adjustments to the amount of tightness.

The clasp could have some other configuration. For example, it could be hook-shaped and the strap could be ring-shaped. The clasp could have a number of notches, like a rack.

Another advantage of the sawtooth teeth is that the discrete steps of adjustment are finer than could be achieved with a notched strip, for equal tooth strength.

What is claimed is:

1. A fastener for a sports shoe comprising, on the one hand, a strip intended to be fixed to a first part of the shoe and on which there is mounted a clasp the position of which can be adjusted by sliding it along the strip and which can be locked in the desired position on the strip and, on the other hand, a tensioner intended to be fixed to a second part of the shoe which is to be fastened to the first part of the shoe and fitted with a strap being bent into the shape of a hook and the end of which has a shape that complements said clasp so that it can be caught on said clasp, wherein the strip has sawtooth teeth on its upper face and the clasp has a crossbar and a pawl that fits between said teeth for the one-way locking, in tension, of the clasp to the strip.

2. A fastener for a sports shoe comprising, on the one hand, a strip intended to be fixed to a first part of the shoe and on which there is mounted a clasp the position of which can be adjusted by sliding it along the strip and which can be locked in the desired position on the strip and, on the other hand, a tensioner intended to be fixed to a second part of the shoe which is to be fastened to the first part of the shoe and fitted with a strap the end of which has a shape that complements said clasp so that it can be caught on said clasp, wherein the strip has sawtooth teeth on its upper face and the clasp has a pawl that fits between said teeth for the one-way locking, in tension, of the clasp to the strip, the clasp having a crossbar, the end of the strap being bent into the shape of a hook and the strap on its underside having a boss situated back from the hook-shaped end and just far enough away from the hook to allow said crossbar to pass and so that the boss comes up against said crossbar before the end of the strap comes up against said pawl.

* * * * *